US005133043A

United States Patent [19]

Baugh

[11] Patent Number: 5,133,043

[45] Date of Patent: Jul. 21, 1992

[54] STRAPLESS, HAND-MOUNTED HAIRDRYER

[76] Inventor: Ronald Baugh, 15058 San Pedro, San Antonio, Tex. 78232

[21] Appl. No.: 623,297

[22] Filed: Dec. 6, 1990

[51] Int. Cl.[5] ..... A45D 20/10; F24H 1/10; H05B 1/00

[52] U.S. Cl. ..... 392/383; 34/97; 34/243 R

[58] Field of Search ..... 392/379-385; 34/96-101, 243 R

[56] References Cited

U.S. PATENT DOCUMENTS

| | | | |
|---|---|---|---|
| 3,986,272 | 10/1976 | Feierabent | 34/97 |
| 4,138,827 | 2/1979 | Baugh et al. | 34/243 R |
| 4,206,556 | 6/1980 | Sabo et al. | 34/243 R |
| 4,620,374 | 11/1986 | Patterson | 34/97 |
| 4,827,105 | 5/1989 | Brown et al. | 392/385 |

FOREIGN PATENT DOCUMENTS

| | | | |
|---|---|---|---|
| 2951562 | 7/1981 | Fed. Rep. of Germany | 392/384 |

*Primary Examiner*—Anthony Bartis

*Attorney, Agent, or Firm*—Gunn, Lee & Miller

[57] ABSTRACT

A hairdrying apparatus having a motor driven blower assembly and a C-shaped air duct of tubular construction discharging adjacent the palm of the user's hand is mountable directly on the user's hand without additional straps. The air duct is configured to tightly extend around an edge of the hand and secure the dryer to the hand as a result of the inherent compression of the C-shape of the duct against the topside and palm of the hand. A layer of resiliently compressible thermal and electrical insulation material may be provided on the surfaces of the duct contacted by the hand to further aid in securing the apparatus to the hand.

5 Claims, 1 Drawing Sheet

STRAPLESS, HAND-MOUNTED HAIRDRYER

BACKGROUND OF THE INVENTION

The present invention relates to a portable hairdrying apparatus, and more particularly to a hairdrying apparatus mountable on the back of the hand of the user and having a discharge duct which secures the apparatus to the hand without the aid of a strap Attempts have been made to improve the process of drying hair while allowing the hair stylist to have full use of his or her hands. One such device is inventor's prior U.S. Pat. No. 4,138,827. Further, U.S. Pat. No. 4,620,374 teaches the use of a hairstylist glove.

Other hairdrying apparatuses are shown and taught in the following utility patents:

U.S. Pat. No. 4,890,395 illustrates and teaches a hand held dryer; U.S. Pat. No. 4,370,544 discloses a flat and compact dryer; U.S. Pat. No. 3,986,272 shows a dryer with a pivotably attached hand grip; U.S. Pat. No. 3,861,060 discloses a dryer with an arched tube designed to be held in the hand and swept forwardly and rearwardly over the crown of the head; U.S. Pat. No. 3,955,065 illustrates a spherical casing on a hand-held dryer.

Various U.S. design patents teach or illustrate different types of housings and ducts, but none of the following design patents teach the unique air duct function or configuration of the present invention: D287,297, D301,231; D294,740; D309,510; D272,101; D265,002; D309,195; D294,873; D289,566; D273,141; D265,514; and D254,451.

The following foreign patents show hairdrying devices: French patent 424,749 illustrates a hand held dryer. French patent 454,686 teaches a dryer which discharges air from a funnel in the user's palm. Japanese patent J63229097A discloses a bedding dryer with a U-shaped handle, but the handle is not an air duct.

SUMMARY OF THE INVENTION

The present invention is a strapless hand-mounted hairdryer having an air blower assembly and an arcuate discharge duct conforming to the user's hand and extending from the output of the blower, which both secures the blower on the hand of the user and directs the air flow to the palm of the hand. The present invention may be quickly transferred from one hand to the other during the hairdrying operation because of its generally C-shaped configuration and easy, strapless release of the unit from the hand.

The discharge duct is designed to urge against the hand in a slight clamping fashion to provide the necessary force to hold the apparatus during manipulation of the user's hand in drying and styling operations.

BRIEF DESCRIPTION OF THE DRAWINGS

In describing the invention in detail, reference is had to the accompanying drawings, forming a part of this specification, and wherein like numerals of reference indicate corresponding parts throughout the several views in which.

DETAILED DESCRIPTION OF THE PREFERRED EMBODIMENT

Figure 1A:
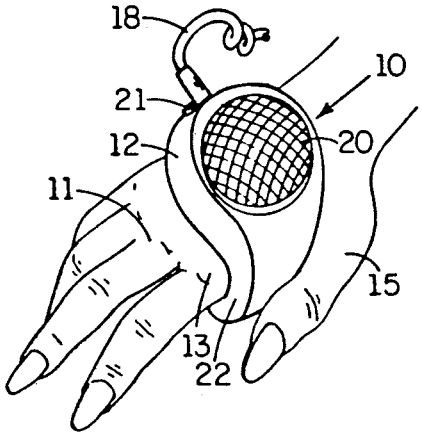
FIG. 1A is a top perspective view of the present invention mounted on the right hand of the user.
Figure 1B:
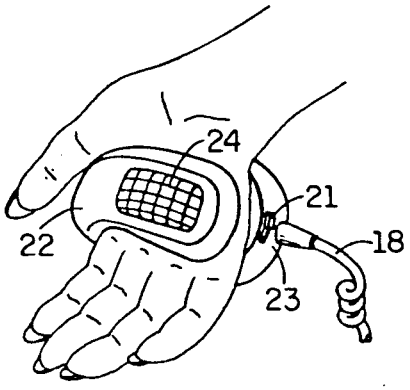
FIG. 1B is a bottom perspective view of the present invention mounted on the right hand of the user.

Referring to FIGS. 1A and 1B, the present invention is shown mounted on the right hand of the user. The invention 10 includes a blower assembly portion 12 having known elements such as a motor driver 13, a blower 15, and a heater coil 17 (not shown) representatively shown in the dotted lines. A power cord 18 is shown extending from the side of the blower assembly 12 and is connected at one end to the driver motor 13 and heater coil 17 and at the other end to a power source (not shown). It should be understood that a battery operated motor is within the scope of the present inventive hairdryer.

Air from the environment is drawn into inlet 20 by operation of the motor and blower through activation of blower on/off switch 21. The heater coil may be activated by switch 21 or by a separate switch which specifically controls the coils as desired by the user. The air is then discharged from the blower from an air outlet 19 into arcuate C-shaped discharge duct 22 and flows out discharge port 24 (FIG. 1B) in the area of the palm of the hand of the user.

As may be seen in FIGS. 1A and 1B, dryer apparatus 10 fits easily and tightly on to the hand 11 of the user without any restriction or restraint to the fingers or thumb and without the aid of any strap. When apparatus 10 is on the right hand of the user the C-shaped duct 22 extends from the top of the hand, around the hand between the base knuckle 13 of the index finger and the base knuckle 15 of the thumb, and into the palm of the hand. As may be further seen in FIGS. 1A and 1B, the C-shape of the duct 22 tightly conforms to the shape of the hand and inherently clamps onto the hand. The duct 22 is a tubular structure or construction (as may be seen from FIGS. 1-3) which inherently resists resilient movement and once tightly attached to the hand will not easily slide off. Preferably, the apparatus 10 and duct 22 are made of rigid plastic materials but could be made of lightweight metals.

Although the apparatus 10 is very light in weight and the clamping action inherent in the C-shaped duct 22 secures the apparatus to the hand, the user is able to simply press the thumb slightly against the duct 22 to hold the unit 10 more securely to the hand.

One of the significant advantages of the present inventive hairdryer is that it may be quickly and easily shifted from one hand to the other without having to disconnect from the hand or wrist any straps or other means for mounting the apparatus to the hand.

Figure 2A:
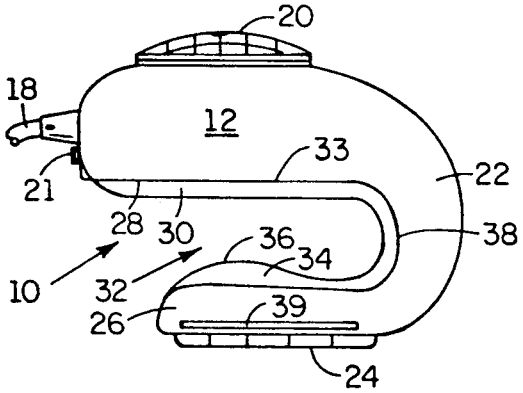
FIG. 2A is a front elevation view of the present invention.
Figure 2B:
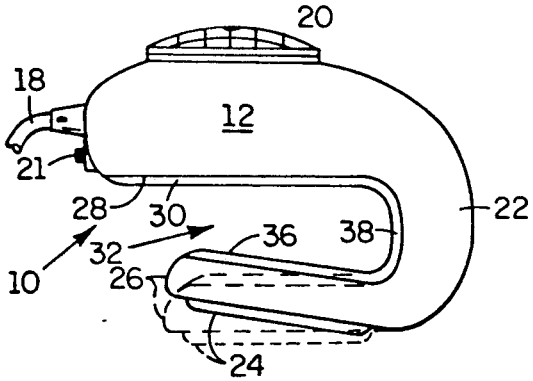
FIG. 2B is a front elevation view of an alternative embodiment of the present invention.

FIG. 2A is a more detailed illustration of the present invention showing the generally C-shaped configuration of the dryer 10. In FIG. 2B an alternate embodiment 10A. illustrates the lower portion 26A of a C-shaped resilient duct 22A in a somewhat closed condition. The dotted lines in FIG. 2B illustrate the lower portion 26A slightly extended, stretched, or flexed in an open position. The duct 22A of FIG. 2B may be made of any material with at least a small amount of inherent resiliency.

When the dryer 10A shown in FIG. 2B is mounted on the hand the lower portion 26A of resilient duct 22A urges against the hand so as to close the duct 22A around the hand and secure it thereon. In addition, the inner surface 28 of the arcuated duct 22A is covered with a compressible insulating material 30. The insulation not only protects the hand from conduction of heat through the duct wall, but also provides shock protection. Because the material 30 is compressible it enables the user to slide the hand into the C-opening 32 with the material pressing against the user's hand thereby substantially securing the device.

FIG. 2A illustrates the invention 10 wherein the lower portion 26 of duct 22 is generally parallel to upper portion 33 of the C-shaped duct, without the slight closing of the C as discussed above. In addition to the inherent clamping action of C-shaped configuration of the duct 22, FIG. 2A shows an additional means for securing the device 10 to the hand by the use of an increased thickness 34 of the compressible insulating material 30 discussed above. This increased thickness 34 extends along the open edge 36 of lower portion 26 and tapers downwardly to a thinner thickness as it extends toward the closed side 38 of the C-shaped duct.

Figure 3:
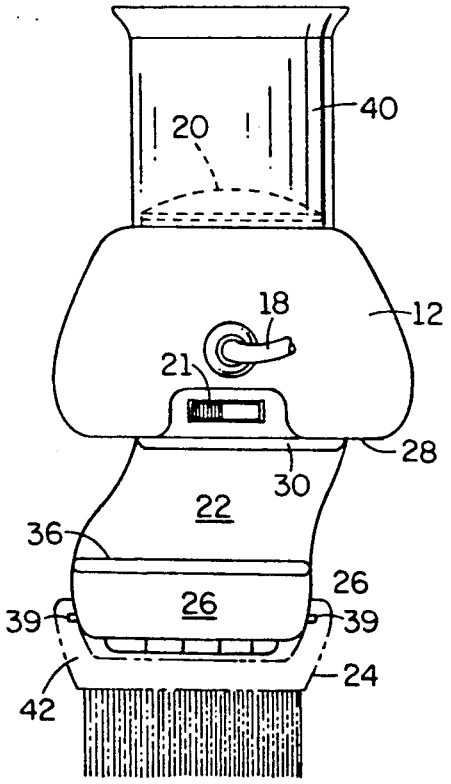
FIG. 3 is a right side elevation view of an embodiment of the present invention with an extended inlet duct and a removable styling attachment.
Figure 1A:
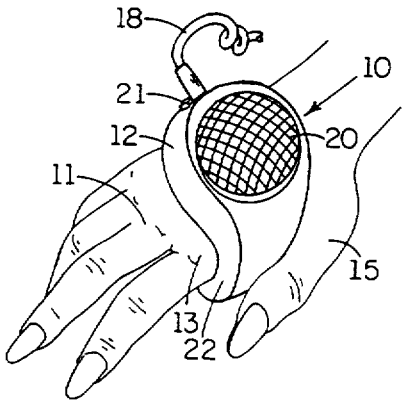
Figure 1B:
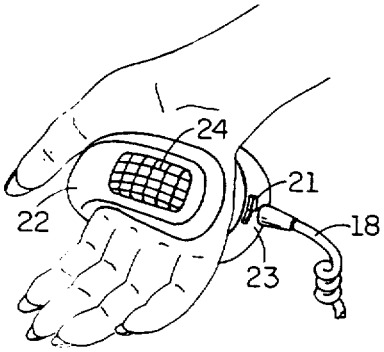
Figure 2A:
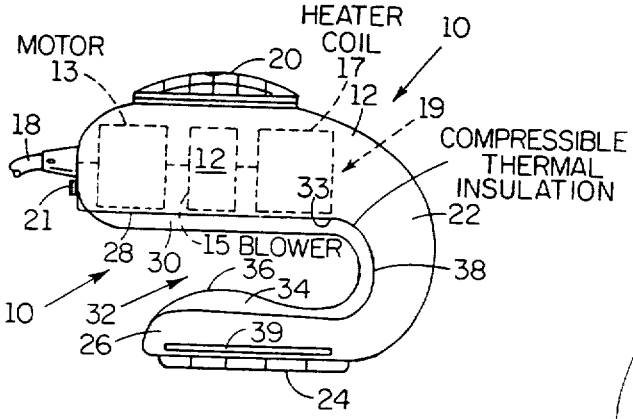
Figure 2B:
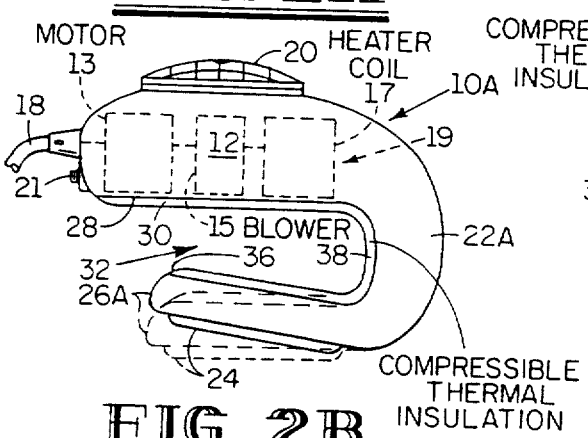
Figure 3:
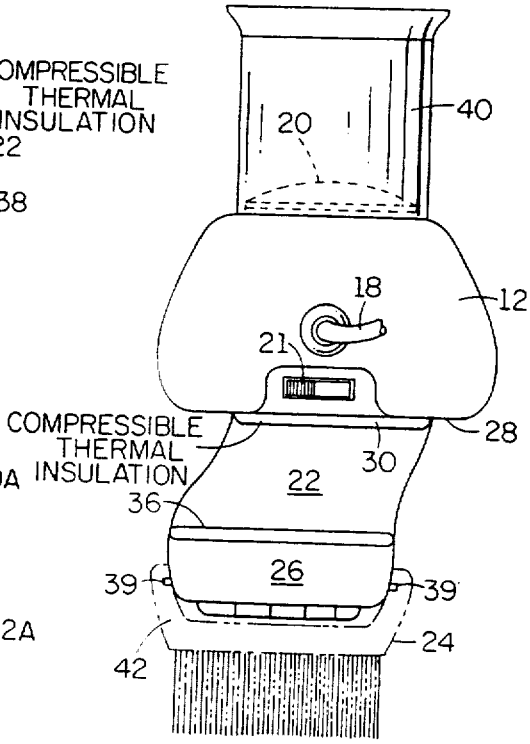

FIG. 3 illustrates a right side elevation view of the invention 10 with an extended inlet duct member 40 attached to the top of the blower assembly 12. Shown in dotted lines is a styling attachment 42 slidably connected to attachment connectors 39 which extend along the outer surface of lower portion 26 of duct 22. Connector 39 may be any suitable means for fastening attachments to the apparatus 10 such that air discharged from discharge port 24 during operation of the apparatus flows through and around the attachment 42.

While the invention has been described in connection with a preferred embodiment, it is not intended to limit the invention to the particular form set forth, but, on the contrary, it is intended to cover alternatives, modifications, and equivalents, as may be included within the spirit and scope of the invention as defined by the appended claims.

I claim:

1. A dryer apparatus for mounting on a user's hand without the aid of a strap comprising:

a motor driven air blower means having an air inlet and an air outlet mountable on the top side of said user's hand;

a C-shaped air duct of tubular construction having a first end secured to said blower means in communication with said air outlet and extending from said blower means tightly around one edge of said hand and terminating at a second end adjacent the palm of said user's hand when said dryer is mounted on said hand, said C-shaped duct conforming tightly to said user's hand and inherently urging against said top of said hand and against said palm of said hand to secure said dryer to said hand.

2. The dryer apparatus of claim 1 wherein said C-shaped air duct further comprises a means thermally and electrically insulating said dryer from said hand, said insulating means being resilient and having a thicker portion near said second end of said duct, said thicker portion extending along an inside surface of said duct from an open side to a closed side of said duct for further urging said duct against said hand.

3. The dryer apparatus of claim 1 wherein said C-shaped duct further comprises a lower section adjacent said second end, said lower section having an air discharge port in said duct and means for connecting styling attachments thereto such that air discharged from said port flows through and around said attachments.

4. The dryer apparatus of claim 1 wherein said C-shaped duct has an upper portion adapted to overlie said top of said user's hand and a lower portion adapted to underlie said palm of said user's hand, said upper portion spaced apart less from said lower portion at an open side of said C-shaped duct than at a closed side of said C-shaped duct.

5. The dryer apparatus of claim 4 wherein said C-shaped duct is made of any material having a small amount of inherent resiliency.

* * * * *

UNITED STATES PATENT AND TRADEMARK OFFICE

CERTIFICATE OF CORRECTION

PATENT NO. : 5,133,043

DATED : July 21, 1992

INVENTOR(S) : Ronald Baugh

It is certified that error appears in the above-indentified patent and that said Letters Patent is hereby corrected as shown below:

On the single drawing sheet containing Figs. 1A, 1B, 2A, 2B, and 3:

delete the entire drawing sheet, and substitute the attached drawing sheet therefor.

Signed and Sealed this

Twenty-fifth Day of October, 1994

*Attest:*

*Attesting Officer*

Bruce Lehman

BRUCE LEHMAN

*Commissioner of Patents and Trademarks*